US009461386B1

(12) United States Patent
Johns

(10) Patent No.: US 9,461,386 B1
(45) Date of Patent: Oct. 4, 2016

(54) SPRING PIN ELECTRICAL CONNECTOR

(71) Applicant: Pebble Technology Corp., Palo Alto, CA (US)

(72) Inventor: Steven W. Johns, Vancouver (CA)

(73) Assignee: Pebble Technology, Corp., Redwood City, CA (US)

( * ) Notice: Subject to any disclaimer, the term of this patent is extended or adjusted under 35 U.S.C. 154(b) by 0 days.

(21) Appl. No.: 14/879,967

(22) Filed: Oct. 9, 2015

(51) Int. Cl.
*H01R 13/17* (2006.01)
*G04G 17/06* (2006.01)

(52) U.S. Cl.
CPC ..... *H01R 13/17* (2013.01); *G04G 17/06* (2013.01)

(58) Field of Classification Search
CPC ..... H01R 13/17; G04G 17/06
USPC ..... 439/37
See application file for complete search history.

(56) References Cited

U.S. PATENT DOCUMENTS 3,032,651 A * 5/1962 Gisiger-Stahli ..... G04B 47/00 368/10
3,729,923 A * 5/1973 Brigliano ..... G04B 19/30 362/103
3,973,706 A * 8/1976 Boyce ..... H01M 2/1044 224/165
4,194,355 A * 3/1980 Nishida ..... G04B 37/1486 368/204
4,690,567 A * 9/1987 Rebeaud ..... G04B 37/1486 368/203
4,947,179 A * 8/1990 Ganter ..... G04R 60/04 343/718
5,008,864 A 4/1991 Yoshitake
5,020,039 A * 5/1991 Yokote ..... G04G 17/083 224/165
5,144,599 A * 9/1992 Blaich ..... G04G 21/04 368/10
5,168,281 A * 12/1992 Tokunaga ..... H01Q 1/273 343/718
5,181,192 A * 1/1993 Paratte ..... G04C 10/00 368/204
5,189,431 A * 2/1993 Marinelli ..... H01Q 1/273 343/718
5,450,091 A * 9/1995 Hama ..... H01Q 1/273 343/718
5,526,006 A * 6/1996 Akahane ..... B29C 45/14065 224/165
5,615,179 A * 3/1997 Yamamoto ..... G04G 17/083 224/168

(Continued)

FOREIGN PATENT DOCUMENTS

EP 2504961 10/2012
EP 002655142-0001 3/2015
EP 002655118-0001 4/2015

OTHER PUBLICATIONS

U.S. Appl. No. 14/827,075, filed Aug. 14, 2015, Townsend, et al.

*Primary Examiner* — Ross Gushi
(74) *Attorney, Agent, or Firm* — Rutan & Tucker, LLP

(57) ABSTRACT

An electrical connector is disclosed that, in one exemplary configuration, includes a connection pin, a spring, an insulator, an outer casing, and a quick-release lever. The electrical connector is used to electrically connect a display device, like a watch, and a securing device, like a watch strap. The electrical connector may be used to create electrical and ground connections between the securing device and the display device from a single point of contact. The quick-release lever may be used for the improved attachment and release of the electrical connector from the display device.

26 Claims, 6 Drawing Sheets

(56) References Cited

U.S. PATENT DOCUMENTS 5,742,256 A * 4/1998 Wakabayashi ..... H01Q 1/273 224/178
5,889,737 A * 3/1999 Alameh ..... G04C 10/00 368/204
5,934,911 A * 8/1999 Stout ..... H01R 13/5219 439/21
5,986,566 A * 11/1999 Yamamori ..... H01Q 1/273 340/7.63
6,158,884 A * 12/2000 Lebby ..... G04B 47/00 224/165
6,175,729 B1 * 1/2001 He ..... A44C 5/24 343/718
6,224,254 B1 * 5/2001 Hayek ..... G04B 47/00 368/10
6,233,203 B1 * 5/2001 Kawata ..... G04C 10/00 368/10
6,329,903 B1 * 12/2001 Yamamori ..... H01Q 1/273 340/7.63
6,350,055 B1 * 2/2002 Barras ..... G04B 37/1486 368/276
6,454,608 B1 * 9/2002 Kitahara ..... H01R 13/2421 439/358
6,535,376 B2 * 3/2003 Fujita ..... A44C 5/0015 343/718
6,540,396 B1 * 4/2003 Barras ..... G04G 17/083 368/12
6,619,835 B2 * 9/2003 Kita ..... A44C 5/0015 368/10
6,634,786 B2 * 10/2003 Dinger ..... G04B 37/1486 368/10
6,788,621 B2 * 9/2004 Meylan ..... A44C 5/0007 368/10
6,854,978 B2 * 2/2005 Noirjean ..... H01Q 1/273 343/718
6,910,911 B2 * 6/2005 Mellott ..... H01R 13/2421 439/180
6,955,552 B2 * 10/2005 Ferri ..... H01R 33/945 200/51.09
7,019,702 B2 * 3/2006 Henriet ..... H01Q 1/273 343/718
7,038,634 B2 * 5/2006 Bisig ..... H01Q 7/00 343/718
7,175,339 B2 * 2/2007 Bisig ..... G04G 17/083 368/204
7,345,954 B2 * 3/2008 Ehrsam ..... A44C 5/18 368/10
7,374,081 B2 * 5/2008 Mosher, Jr. ..... E05B 73/0017 235/380
7,397,437 B2 * 7/2008 Hasumi ..... G04B 37/1486 343/718
7,442,060 B2 * 10/2008 Suwalski ..... H01R 13/6275 439/180
7,474,592 B2 * 1/2009 Lyon ..... G04G 17/083 368/10
7,568,263 B2 * 8/2009 Kim ..... G04B 37/1486 24/265 B
D641,349 S 7/2011 Baumann et al.
8,050,716 B2 * 11/2011 Shin ..... H04B 1/385 368/10
8,170,633 B2 * 5/2012 Shin ..... H04B 1/385 455/558
8,235,586 B2 * 8/2012 Li ..... G04G 17/08 368/13
8,241,053 B2 * 8/2012 Slippy ..... H01R 13/5808 439/353
8,249,547 B1 * 8/2012 Fellner ..... G08B 21/0446 455/404.1
8,262,403 B2 * 9/2012 Slippy ..... H01R 13/5808 439/353
8,419,268 B2 * 4/2013 Yu ..... G04C 10/00 368/204
8,976,628 B2 * 3/2015 Leoni ..... G04G 21/00 368/10
D733,142 S 6/2015 Solomon et al.
D743,278 S 11/2015 Solomon et al.
D745,515 S 12/2015 Solomon et al.
9,274,506 B2 * 3/2016 Lu ..... G04G 17/02
2002/0104192 A1 * 8/2002 Iguchi ..... A44C 5/12 16/386
2002/0104200 A1 * 8/2002 Iguchi ..... A44C 5/0007 24/265 WS
2003/0099164 A1 * 5/2003 Noirjean ..... A44C 5/0007 368/282
2004/0023556 A1 2/2004 Smith
2004/0081025 A1 * 4/2004 Chen ..... G04B 37/1486 368/10
2004/0084200 A1 * 5/2004 Noirjean ..... H01Q 1/273 174/50
2005/0095899 A1 * 5/2005 Mellott ..... H01R 13/2421 439/358
2006/0013074 A1 * 1/2006 Ueno ..... G04C 17/00 368/226
2006/0140055 A1 * 6/2006 Ehrsam ..... A44C 5/18 368/10
2007/0064542 A1 * 3/2007 Fukushima ..... G04B 37/1486 368/282
2007/0279852 A1 * 12/2007 Daniel ..... A44C 5/0007 361/679.03
2011/0053666 A1 3/2011 Kang et al.
2011/0056723 A1 * 3/2011 Slippy ..... H01R 13/5808 174/73.1
2011/0059642 A1 * 3/2011 Slippy ..... H01R 13/5808 439/353
2013/0040610 A1 2/2013 Migicovsky et al.
2015/0126117 A1 5/2015 Wong et al.
2015/0212541 A1 7/2015 Lu
2015/0223033 A1 8/2015 Migicovsky et al.
2015/0223034 A1 8/2015 Migicovsky et al.
2015/0277384 A1 * 10/2015 Mankowski ..... G04G 21/04 368/10
2015/0333302 A1 * 11/2015 Johns ..... H01M 2/1066 429/127
2015/0334772 A1 11/2015 Wong et al.
2016/0006201 A1 * 1/2016 Kim ..... H01R 13/6205 439/37
2016/0062392 A1 * 3/2016 Townsend ..... G06F 1/163 361/679.03
2016/0088880 A1 * 3/2016 Tulloch ..... H01R 31/06 439/37

* cited by examiner

SPRING PIN ELECTRICAL CONNECTOR

FIELD OF THE INVENTION

The invention relates to the field of electrical connectivity. More particularly, the invention relates to an electrical connector, with a spring, such as a watch, that establishes a power, data, and/or ground connection between a display device and a securing device.

BACKGROUND OF THE INVENTION

In the art, there is an absence of an electrical connector that is able to provide power, data, and/or ground connections, while being fabricated to be unobtrusive during use.

There is consequently a need for an electrical connector resolving any or all of the foregoing issues. Further there is a need for an electrical connector that fits between a display device and a securing device, while providing power, data, and/or ground connections as necessary.

SUMMARY OF THE INVENTION

Electrical connectivity is an important component in the use of such display devices as smartwatches and other portable and wearable electronic devices. These display devices may be paired with a securing device, such as a strap, that provides additional functionalities, for example power or data. In such cases, the display device and the securing device must be electrically connected. Exemplary configurations of securing devices and display devices are disclosed in U.S. patent application Ser. No. 14/827,215, with a filing date of Aug. 14, 2015, which is incorporated herein by reference in its entirety. An electrical connection between the display and securing devices may allow power and/or data to flow between the display device and the securing device.

Accordingly, herein is provided an improved electrical connector and an improved electrical connector with a spring. The connector creates both a physical attachment connection as well as an electrical connection between two devices. An electrical connector may have a spring that can be used to provide a consistent power, data, and/or ground connection between a display device and a securing device. An electrical connector may use a spring that allows for multiple electrical (power and/or data) connections. An electrical connector may have multiple connections at a single physical location via concentric contact points that are insulated from one another. An electrical connector may use a spring that provides a consistent power, data, and/or ground connection between a display device and a securing device that further includes a side interface capable of providing an additional power or data connection.

In an exemplary configuration, the electrical connector comprises an outer casing terminating in a cap and a connection pin having an uncovered portion and a portion covered by the outer casing. A spring is operably attached to the connection pin. The uncovered portion of the connection pin establishes an electrical connection between a securing device and a display device and the outer casing establishes a ground connection between the securing device and the display device. While the electrical connector has established that connection, the securing device is able to rotate relative to the display device while maintaining the electrical connection and the ground connection between the securing device and the display device. In variations of this configuration, the electrical connector may include a substructure for attaching it to the securing device. The electrical connector may also include a separate ground connection band, in which case, the outer casing will act as the insulator. The electrical connector may additionally include a quick-release lever for the improved attachment and release of the electrical connector from the display device.

In another configuration of the electrical connector, there are two different connection pins. The first connection pin is partially covered by a first pin insulator that terminates in a first cap. A spring is operably attached to the first connection pin. The second connection pin is partially covered by a second pin insulator that also terminates in a second cap. A spacer rests between the two caps, separating the two connection pins. The uncovered portion of the first connection pin establishes an electrical or ground connection between a securing device and a display device and the uncovered portion of the second connection pin establishes an electrical or ground connection between the securing device and the display device.

In variations of this configuration, the two connection pins are removably attached to the securing device and are arranged linearly to point in substantially opposite directions. In other variation of this configuration, the first connection pin and the second connection pin are removably connected to the display device such that the securing device is able rotate relative to the display device while maintaining the power or data connection and the ground connection between the securing device and the display device. In certain other variations of this configuration, the spacer may be an insulator or a hollow molded space between the first cap and the second cap of the pin insulators.

In yet another configuration of the electrical connector, there are two connection pins and a side interface. The first connection pin is partially covered by a first pin insulator that terminates in a first cap. A spring is operably attached to the first connection pin. The second connection pin is partially covered by a second pin insulator that also terminates in a second cap. The side interface is located between the first connection pin and the second connection pin along the longitudinal axis of the electrical connector. A spacer rests between the two caps, separating the two connection pins and the side interface from each other. The uncovered portion of the first connection pin establishes an electrical or ground connection between a securing device and a display device and the uncovered portion of the second connection pin establishes an electrical or ground connection between the securing device and the display device. The side interface establishes an additional electrical or ground connection between the securing device and the display device.

In variations of this configuration, the first connection pin, the second connection pin, and the side interface are removably connected to the display device such that the securing device is able rotate relative to the display device while maintaining the power and/or data connection and the ground connection between the securing device and the display device. In other variations of this configuration, the electrical connector may include a substructure for attaching the electrical connector to the securing device. This substructure may be a flange, tab, insert, or other coupling device. In certain other variations of this configuration, the spacer may be an insulator or a hollow molded space between the first cap and the second cap of the pin insulators. In yet other variations of this configurations, the side interface may be a lobe that protrudes from the longitudinal axis of the electrical connector. In that variation, the first connection pin, the second connection pin, and the lobe are removably connected to the display device such that the securing device is able rotate relative to the display device while maintaining the electrical and the ground connections between the securing device and the display device.

In yet another configuration of the electrical connector, there are concentric connection pins. The first connection pin is partially covered by a first pin insulator. A spring is operably attached to the first connection pin. A concentric pin encircles the first pin insulator. The concentric pin is partially covered by a second insulator. A ground casing the covers the second insulator. In this configuration, the uncovered portion of the central connection pin establishes an electrical connection between a securing device and a display device, the uncovered portion of the first concentric pin establishes an electrical connection between the securing device and a display device, and the ground casing establishes a ground connection between the securing device and the display device.

In variations of this configuration, the concentric pin electrical connector is removably attached to the securing device, and the connection pin, the first concentric pin, and ground casing are removably connected to the display device such that the securing device is able rotate relative to the display device while maintaining the electrical connection and the ground connection between the securing device and the display device. In other variations of this configuration, the concentric pin electrical connector has a substructure for attaching the connector to the securing device. The substructure may be a flange, a tab, an insert, or other coupling device. In yet other configurations, the concentric pin electrical connector may include a quick-release lever for the improved attachment and release of the electrical connector from the display device.

These will become more readily apparent when reference is made to the following description, taken in conjunction with the accompanying drawings.

BRIEF DESCRIPTION OF THE FIGURES

A more complete appreciation of the invention and many of the attendant advantages thereof will be readily obtained as the same becomes better understood by reference to the following detailed description when considered in conjunction with the accompanying drawings, wherein.

DETAILED DESCRIPTION

Figure 1A:
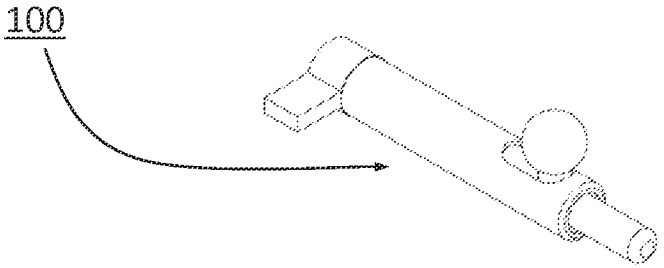
FIG. 1A shows an isometric views of an exemplary electrical connector, as designed in a configuration including a quick-release lever.

In describing aspects of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several aspects of the invention are described for illustrative purposes, it being understood that the invention may be embodied in other forms not specifically shown in the drawings.

Figure 1B:
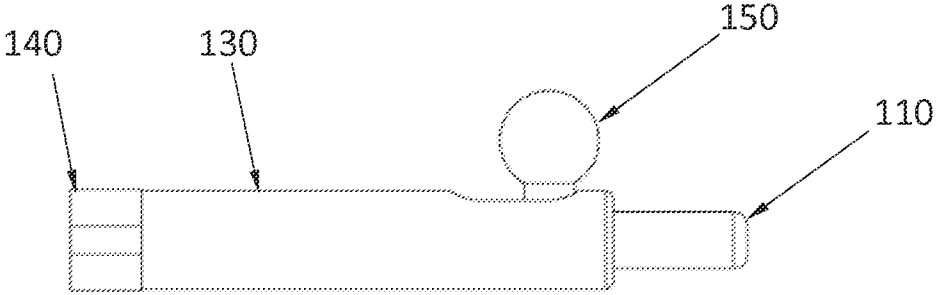
FIG. 1B shows a side view of an exemplary electrical connector, as designed in a configuration including a quick-release lever.
Figure 1C:
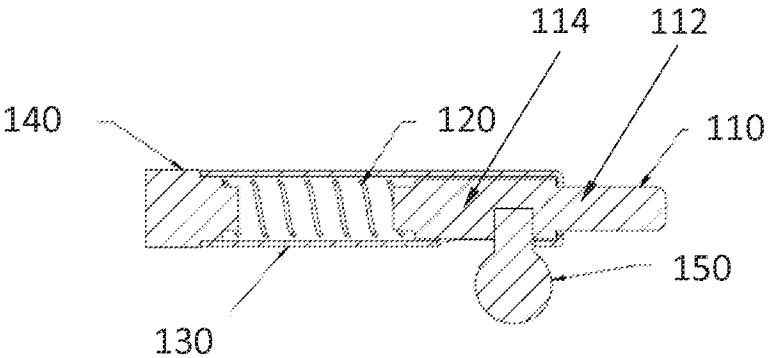
FIG. 1C shows a sectional view of an exemplary electrical connector, as designed in a configuration including a quick-release lever.

FIGS. 1A, 1B, and 1C show the following components of an electrical connector 100: a connection pin 110, the uncovered portion 112 of the connection pin 110, the covered portion 114 of the connection pin, a spring 120, an outer casing 130, a cap 140, and a quick-release lever 150. FIGS. 1A, 1B, and 1C show an electrical connector 100, in a configuration that includes a quick-release lever 150. Generally, the electrical connector 100 has an elongated tube or pipe shape. The outer casing 130 of the electrical connector 100 has a tubular shape with an opening inside and two ends, a cap end and a connection end.

As is shown and described, the electrical connector 100 is configured to make both a physical connection for attachment as well as an electrical connection between a display device (e.g. a watch, a wristband, a fitness tracker, or a smart necklace) and a securing device (e.g. a strap or a neckband).

In FIG. 1B, the quick-release lever 150 of the electrical connector 100 protrudes from the outer casing 130. In another embodiment, the quick-release lever 150 may be nearly flush with the outer casing 130. The outer casing 130 terminates at one end with a cap 140. The cap 140 may comprise a soldering pad (shown as the tab in FIG. 1A) or any other acceptable material known in the art for performing the same function. The soldering pad of the cap 140 may be used as a substructure to attach the electrical connector 100 to a securing device. At the other end of the outer casing 130, the connection pin 110 protrudes from inside the outer casing 130. The electrical connector 100 as shown in FIG. 1 has three operable positions: a resting state position, a compressed position and an installed position. When not in use, the electrical connector 100 is in the resting state position and the spring 120 is in a more extended state or stretched state. When compressed, usually just prior to installation, the electrical connector 100 is in a compressed state and the spring 120 is compressed more than it would be in either the resting state or installed state. In the installed state, the spring 120 extension is in between the state of rest and the state of compression.

FIG. 1C shows internal aspects of the electrical connector. As shown herein, the connection pin 110 is further comprised of an uncovered portion 112 and a covered portion 114. The covered portion 114 allows for the electrical connection between the display device and the securing device, but is non-conductive in the sense that it is electrically isolated from the ground connection and the data connection between the devices due to being covered by the outer casing 130. The outer casing 130 contains a cap 140 that acts as a mechanical stop for spring 120. The spring 120 may be compressed by pulling the quick-release lever 150 towards the cap 140. The spring 120 is also in a partially compressed state when the connection pin 110 is in an installed position and is partially pushed towards the cap 140. The spring 120 sits between the cap 140 and the connection pin 110. The spring 120 is compressed between the cap 140 and the connection pin 110 when the uncovered portion 112 of the connection pin 110 pushes against the point of contact on the display device. Pulling back on the quick-release lever 150 to compress the spring 120 allows for removal of the electrical connector 100 from its installed position (connecting the display device and securing device), as is further described below with reference in FIG. 3A below.

The uncovered portion 112 of the connection pin 110 is designed to push against a point of contact on the display device, creating an electrical connection. In that installed position, the uncovered portion 112 pushed against the point of contact, the covered portion 114 is positioned to compress the spring 120, resulting in the initiation of an electrical connection, which may involve a transfer of power or data between the display device and the securing device. In general, the electrical connection from the display device passes from the connection pin 110, through the spring 120, and through the cap 140. The cap 140 may be connected to electronic components or batteries (not shown) in the securing device. These electrical connections between the cap 140 and the components of the securing device may comprise leads, soldering metals, or other ways of connection to the securing device.

In certain configurations, the outer casing 130 of the electrical connector 100 may act as a ground connection. In those configurations, the outer casing 130 may include a ground layer molded between an inner insulator that separates the ground connection from the connection pin 110 and an outer layer that encloses the electrical connector 100. This sandwiched ground layer of the outer casing 130 is responsible for establishing the ground connection between the display device and the securing device.

Figure 1E:
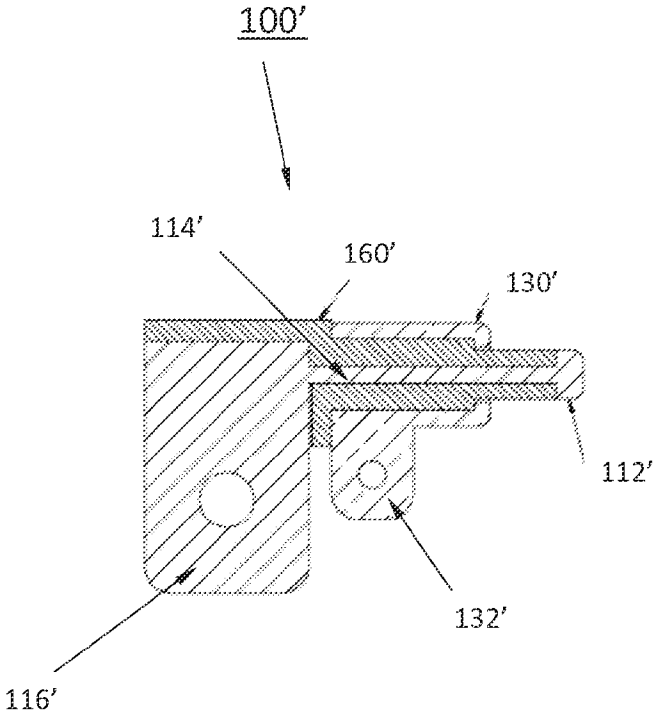
FIG. 1E shows a sectional views of an exemplary electrical connector, as designed in a configuration with a substructure for attaching the connector to a securing device.
Figure 1D:
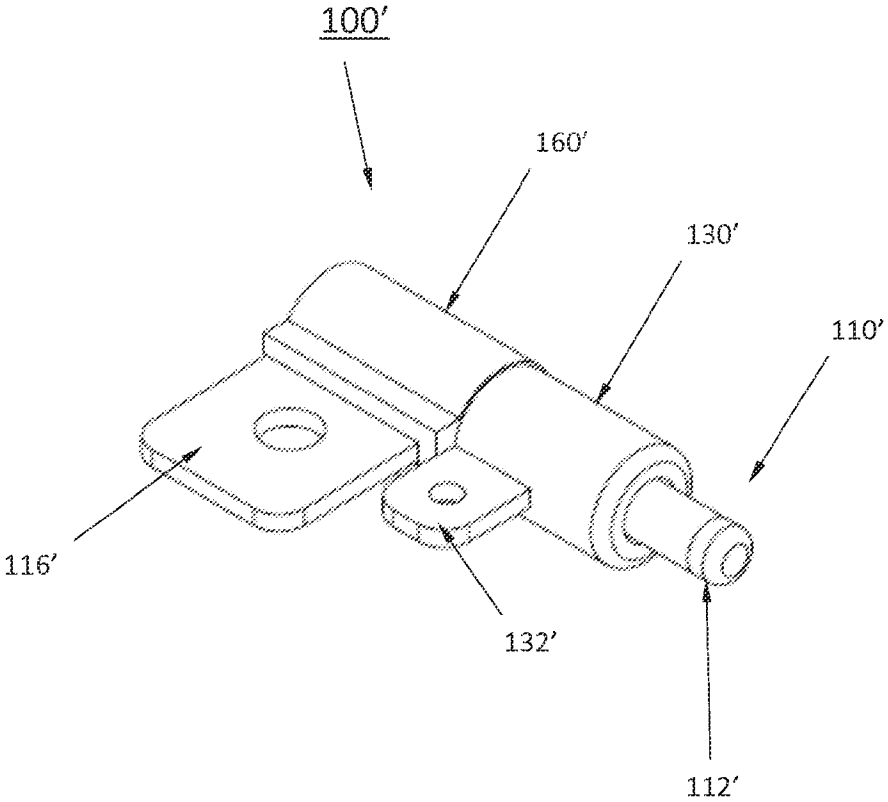
FIG. 1D shows an isometric view of an exemplary electrical connector, as designed in a configuration with a substructure for attaching the connector to a securing device.

FIGS. 1D and 1E shows a springless electrical connector 100' configuration (and without a quick-release lever). In this electrical connector 100', the connection pin 110' protrudes from the outer casing 130', which may also serve as an insulator. The connection pin 110' is further comprised of an uncovered portion 112' and a covered portion 114'. The covered portion 114' allows for the electrical connection between the display device and the securing device, but it is electrically isolated from and makes no contact with the ground connection and the data connection between the devices. At one end of the covered portion 114', the connection pin 110' may terminate in a substructure 116', which may be a flange, a tab, an insert, a coupling device, or other ways of attaching known in the art. This substructure 116' may be used to attach the electrical connector 100' to a securing device while also establishing an electrical connection between the securing device and the display device. While not shown in FIG. 1A-1C, such a substructure 116' may also be used with the electrical connector 100 having a spring. The covered portion 114' and the substructure 116' preferably remain electrically isolated from the ground connection and the data connection between the devices. Thus, the covered portion 114' and the substructure 116' are surrounded by a pin insulator 160', such that the electrical signal or electrical charge flows through the connection pin 110'. This orientation allows for the electrical connection to be separate from the outer casing 130'.

In certain installations of the electrical connector 100', the outer casing 130' may serve as the ground connection. In other installations of the electrical connector 100', there may exist a separate ground connection band between the outer casing 130' and the pin insulator 160'. The ground connection band or the outer casing 130', when used as a ground connection, may have a further substructure used to attach the electrical connector 100' to a securing device, while also establishing a ground connection with the securing device. In FIGS. 1D and 1E, the substructure 132' appears as a component of the outer casing 130'.

The springless electrical connector 100' is contemplated as being a point of both physical and electrical connection between a securing device, such as a smartwatch band, and a display device, such as a smartwatch. In some cases, the electrical connector 100' may be used in conjunction with electrical connector 100, such that the two connectors together establish separate points of connection between a securing device and a display device. In such a configuration, the connectors 100 and 100' can each establish electrical connections. In fact, each can establish multiple electrical connections between a securing device and a display device.

Figure 2A:
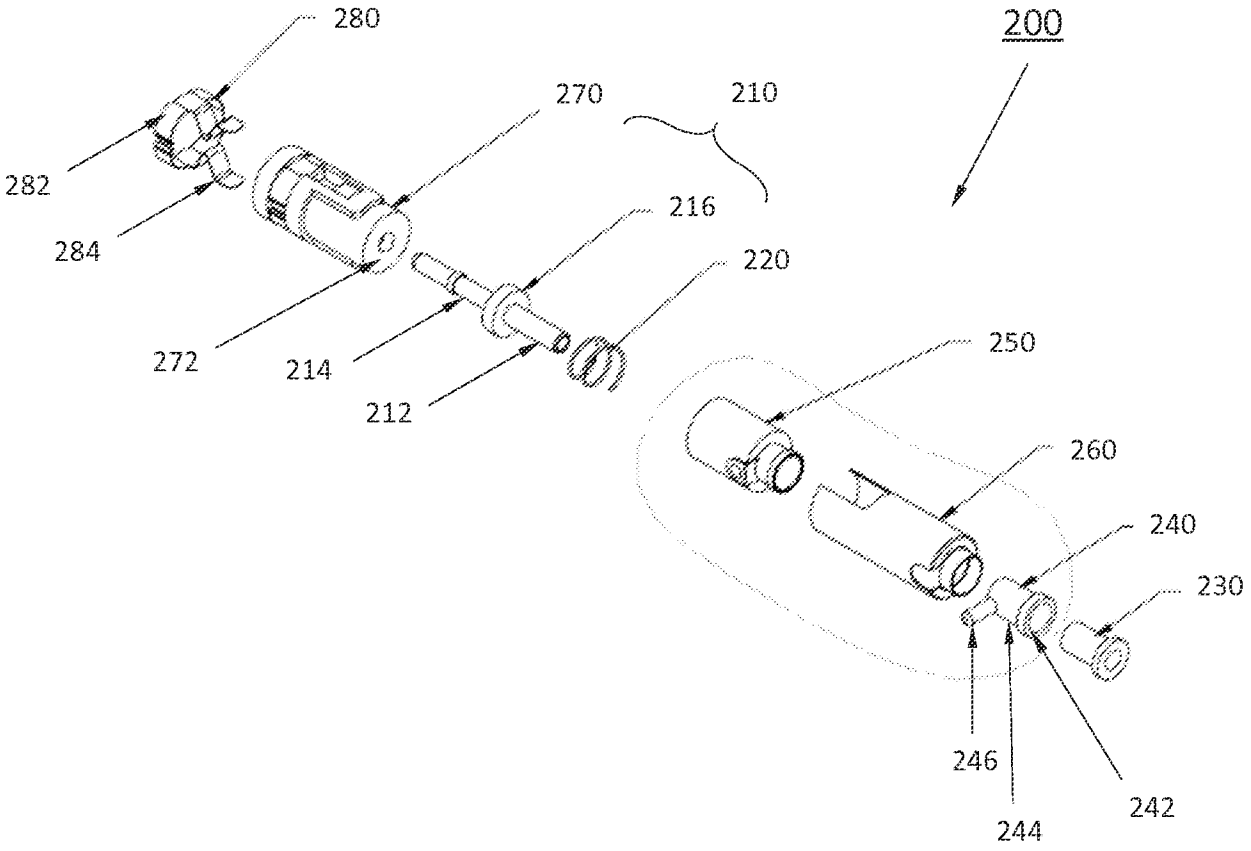
FIG. 2A shows an exploded isometric view of an exemplary electrical connector, as designed in a configuration with concentric pins.

FIG. 2A shows yet another variation of the electrical connector, as a concentric pin electrical connector 200. In this configuration, the concentric pin electrical connector 200 allows for the optional establishment of power, data, and ground connections between the securing device and the display device. The configuration, as explained below, is designed such that power, data, and ground connections can be established from a single point comprised of a central connection pin 210 and a concentric pin 240 separated by insulators.

In the exploded isometric view of the concentric pin electrical connector 200 in FIG. 2A, which shows a primarily cylindrical configuration, the connection pin 210 passes centrally through the concentric pin electrical connector 200. The connection pin 210 is comprised of an uncovered portion 212, a covered portion 214, and a central disk 216. The three parts 212, 214, 216 of the connection pin 210 may be constructed as a single machined part, a long pin with a donut shaped central disk 216, three separate parts that fit together, or other combination. A spring 220 may be operably positioned surrounding the uncovered portion 212, attached to the uncovered portion 212, and/or attached to the central disk 216. Typically, the spring 220 is situated so that it rests against the central disk 216 on one end of the connection pin 210. The uncovered portion 212 and the spring 220 are surrounded by a first insulator 230 in a manner that leaves the uncovered portion 212 capable of making contact with the display device. The first insulator 230 acts as a casing around the uncovered portion 212 and the spring 220, such that a first concentric pin 240 is electrically isolated from the connection pin 210. The first insulator 230 has a radially projecting circular lip at the external end surrounding the uncovered portion 212 of connection pin 210. In this configuration, the spring 220 rests between the circular disk 216 and the radially projecting circular lip of the first insulator 230. When the uncovered portion 212 of the connection pin 210 pushes against the point of contact on the display device, the spring 220 is compressed between the circular disk 216 and the radially projecting circular lip of the first insulator 230. The first concentric pin 240, like the connection pin 210, is capable of establishing either a power or a data connection between the securing device and the display device.

The first concentric pin 240 is comprised of an uncovered portion 242 and a covered portion 244. The first concentric pin 240 may also include a quick release lever 246 that can be used to move the first concentric pin 240 by compressing the spring 220, thereby allowing for the concentric pin electrical connector 200 to be removed from the display device. It will be readily apparent to one of ordinary skill in the art that the quick-release lever 246, shown in FIG. 2A as a part of the first concentric pin 240, may originate as a component of the connection pin 210 or any other layer described herein, as long as it is capable removing the connection pin 210 from the display device (by compressing the spring 220) in a manner that allows for the concentric pin electrical connector 200 to be removed from the display device. Moreover, depending on which component of the concentric pin electrical connector 200 the quick-release lever 246 is a part of, other components external to the quick-release lever may be machined or molded such that the quick-release lever 246 is accessible from the surface of the concentric pin electrical connector 200.

The uncovered portion 242 of the first concentric pin 240 is situated around the uncovered portion 212 of the connection pin 210 such that when the connection pin 210 establishes an electrical connection between the display device and the securing device, the first concentric pin 240 does so as well. The covered portion 244 of the first concentric pin 240 is covered with a second insulator 250. This second insulator 250 acts as a casing around the covered portion 244, such that a first concentric pin 240 is electrically isolated from the ground casing 260.

The second insulator 250 is covered by a ground casing 260. The second insulator functions to maintain electrical separation between the ground casing 260 and the first concentric pin 240. The ground casing 260 is situated around the second insulator 250 such that when the connection pin 210 and first concentric pin 240 establish an electrical connection between the display device and the securing device, the ground casing 260 establishes a ground connection between the display device and the securing device. As shown in FIG. 2A, in certain configurations, the first concentric pin 240, the second insulator 250, and the ground casing 260 may be molded together as a single combined piece that fits over the connection pin 210, the spring 220, and the first insulator 230.

The external surface of the electrical connector 200 is formed by an insulator casing 270, which wraps around the ground casing 260. The insulator casing 270 may have an internal protrusion 272 that acts as a mechanical stop for the spring 220, against which it can compress. At the end distal to the point of contact for the connector pin 210, a cap 280 is operably attached to the insulator casing 270. The cap 280 is further comprised of a base 282 and one or more contacts 284, from which the one or more contacts 284 extend towards the connection pin 210. In the other direction, the one or more contacts 284 may also extend away from the connection pin 210 to allow for attachment and electrical connection to the securing device. The one or more contacts 284 may also be machined or molded to bend radially inward as they extend towards the connection pin 210.

Figure 2C:
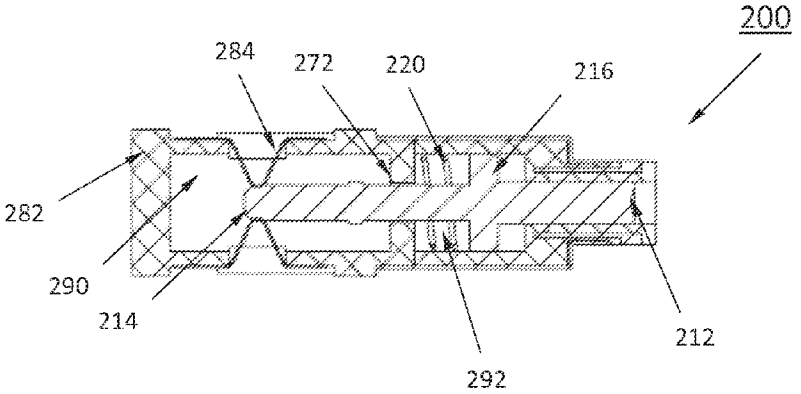
FIG. 2C shows a sectional view of an exemplary electrical connector that uses concentric pins, as designed in a configuration with concentric pins in an installed state.
Figure 2B:
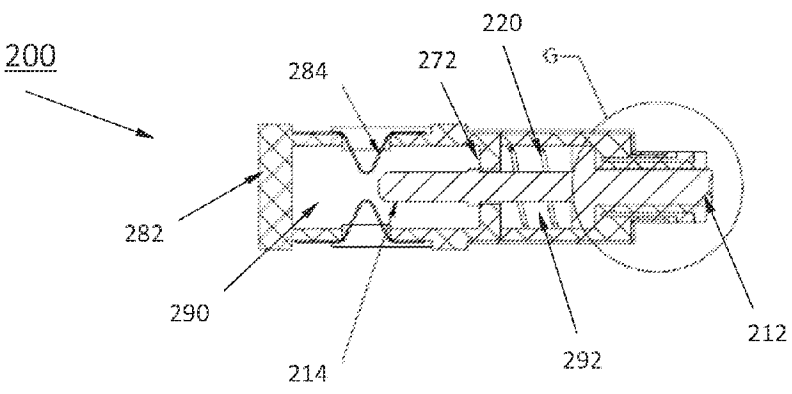
FIG. 2B shows a sectional view of an exemplary electrical connector that uses concentric pins, as designed in a configuration with concentric pins in a resting state position.

An exemplary operation of concentric pin electrical connector 200 is shown in FIG. 2B and FIG. 2C. FIG. 2B shows a cross-section of a concentric pin configuration of the concentric pin electrical connector 200 in a resting state position, where an electrical connection does not exist between the display device and the securing device. FIG. 2C shows concentric pin electrical connector 200 in an installed position, where an electrical connection does exist between the display device and the securing device.

When the concentric connector 200 is in the resting state position, there is no electrical connection between the connection pin 210 and the one or more contacts 284. This provides a useful feature in that it electrically isolates the connection pin 210 from the securing device and prevents any shorts, drainage of the battery, or electrical damage to the device while in the resting position. This isolation prevents static electrical charges originating from the connection pin 210 from damaging or shorting the components. When compressed, usually just prior to installation, the concentric pin electrical connector 200 is in a compressed state and the spring 220 is compressed more than it would be in either the resting state or installed state. In the installed state, the spring 220 is in between the state of rest and the state of compression.

The cap 280, located on the distal end of the electrical connector 210, is stationary, preferably molded to the insulator casing 270. From the base 282 of the cap 280, one or more contacts 284 extend along the longitudinal axis of the concentric pin electrical connector 200, towards the connection pin 210.

The one or more contacts 284 preferably extend into a hollow inner chamber 290 within the concentric pin electrical connector 200. The one or more contacts 284 may be molded or machined in such a manner that they extend into the center of the hollow inner chamber 290, allowing for the connection pin 210 to make contact with them when the spring 220 is compressed. The hollow inner chamber 290 is preferably separated from a hollow spring chamber 292 by an internal protrusion 272 of the insulator casing 270. The internal protrusion 272 may be a tab, a flange, or a cylindrical disk, or other means. The internal protrusion 272 typically operates as a mechanical stop for the spring 220. It will be readily apparent that any of the other concentric insulator layers of the concentric pin electrical connector 200 may be molded to form the internal protrusion 272, so long as the structure operates as a mechanical stop for the spring 220. As shown in FIG. 2B, the spring 220 is compressed within the hollow spring chamber 292 between the internal protrusion 272 and the central disk 216 of the connection pin 210 when the uncovered portion 212 of the connection pin 210 pushes against the point of contact on the display device.

In the configuration shown in FIG. 2B, the internal protrusion 272 is structured in such a manner that the covered portion 214 of the connection pin 210 may pass through the center of the inner protrusion 272. When not connected to the display device, the concentric pin electrical connector 200 is in its resting state position, shown as FIG. 2B. When the uncovered portion 212 of the connection pin 210 is pushed inwards by the contact on display device, the spring compresses against the inner protrusion 272, and the covered portion 214 of the connection pin 210 passes through the central disk 216 until it abuts the one or more contacts 284. This contact results in an electrical connection between the display device and the securing device and the electrical connector adopting the installed position, as shown in FIG. 2C. As demonstrated by FIGS. 2A, 2B, and 2C, the spring 220 can be situated either in front of, or behind, the central disk 216 of the connection pin 210, so long as the compression of the spring 220 results in the covered portion 214 of the connection pin 210 abutting the one or more contacts 284.

In general, the electrical connection between the display device and the securing device comprises the connection pin 210, the spring 120, and the one or more contacts 284, which may have leads or other ways of connecting to the securing device. Each of these components are connected to the next in a manner that allows electrical signals to pass. When an electrical signal is transmitted from the display device to the securing device, the signal takes the following path: the connection pin 210 to the one or more contacts 284 to the securing device. Typically, electrical signals or power can pass through these components in either direction.

When in the fully compressed position (not shown), the covered portion 214 of the connection pin 210 the concentric pin electrical connector 200 is retracted so that its distal end moves beyond the one or more contacts 284 into the hollow inner chamber 290.

Figure 2E:
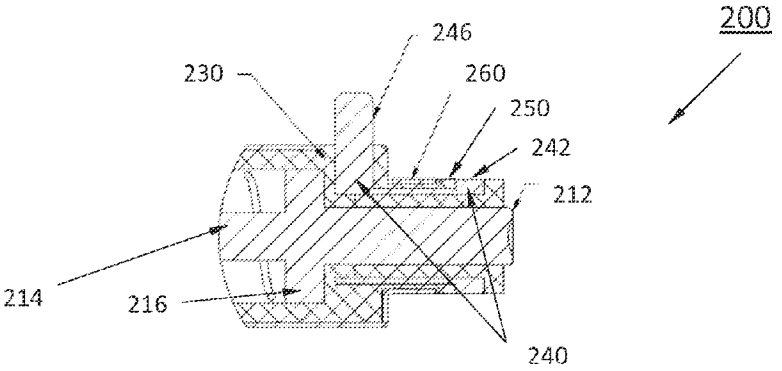
FIG. 2E shows a portion of an exemplary electrical connector that uses concentric pins, as designed in a configuration with a side interface.
Figure 2D:
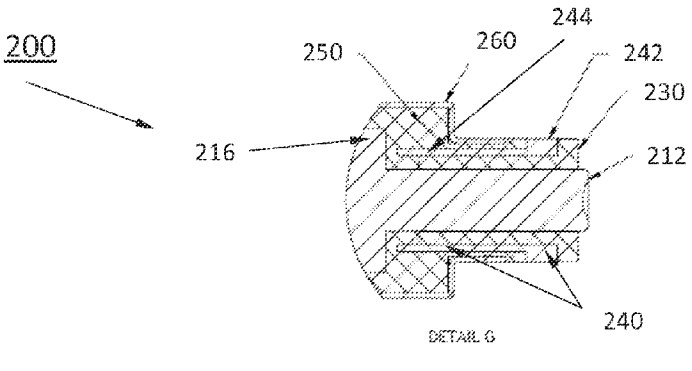
FIG. 2D shows a portion of an exemplary electrical connector that uses concentric pins, as designed in a configuration without a side interface.

FIG. 2D and FIG. 2E compare alternate configurations of the concentric pin electrical connector 200, in which the first concentric pin 240 terminates in a side interface 246 (FIG. 2E) rather than a covered portion 244 (FIG. 2D), or the quick release lever 246 of FIG. 2A. The side interface 246 extends orthogonally from the longitudinal axis of the concentric pin electrical connector 200 and is designed to make contact with its mated interface on the display device. In this alternate configuration, therefore, it is possible to maintain a power, data, and ground connection through a single concentric pin electrical connector 200. The side interface 246 may be designed as a flat, curved point of contact, a protruding lobe, or insert. Preferably, the side interface 246 will mate with the interface on the display device in a manner that maintains at least some degree of rotation for the securing device about the display device. The ground connection and the power connection are established as described above.

It will be readily apparent to one of ordinary skill in the art that the concentric pin configurations of FIGS. 2A, 2B and 2C, 2D, and/or 2E may be arranged or ordered in such a manner that the power, data, and ground connection may be established through any of the three points of contact described herein. It will also be readily apparent that additional concentric pins may be added to the electrical connector 200, as long as those additional pins are separated from existing pins by an insulator.

Figure 3A:
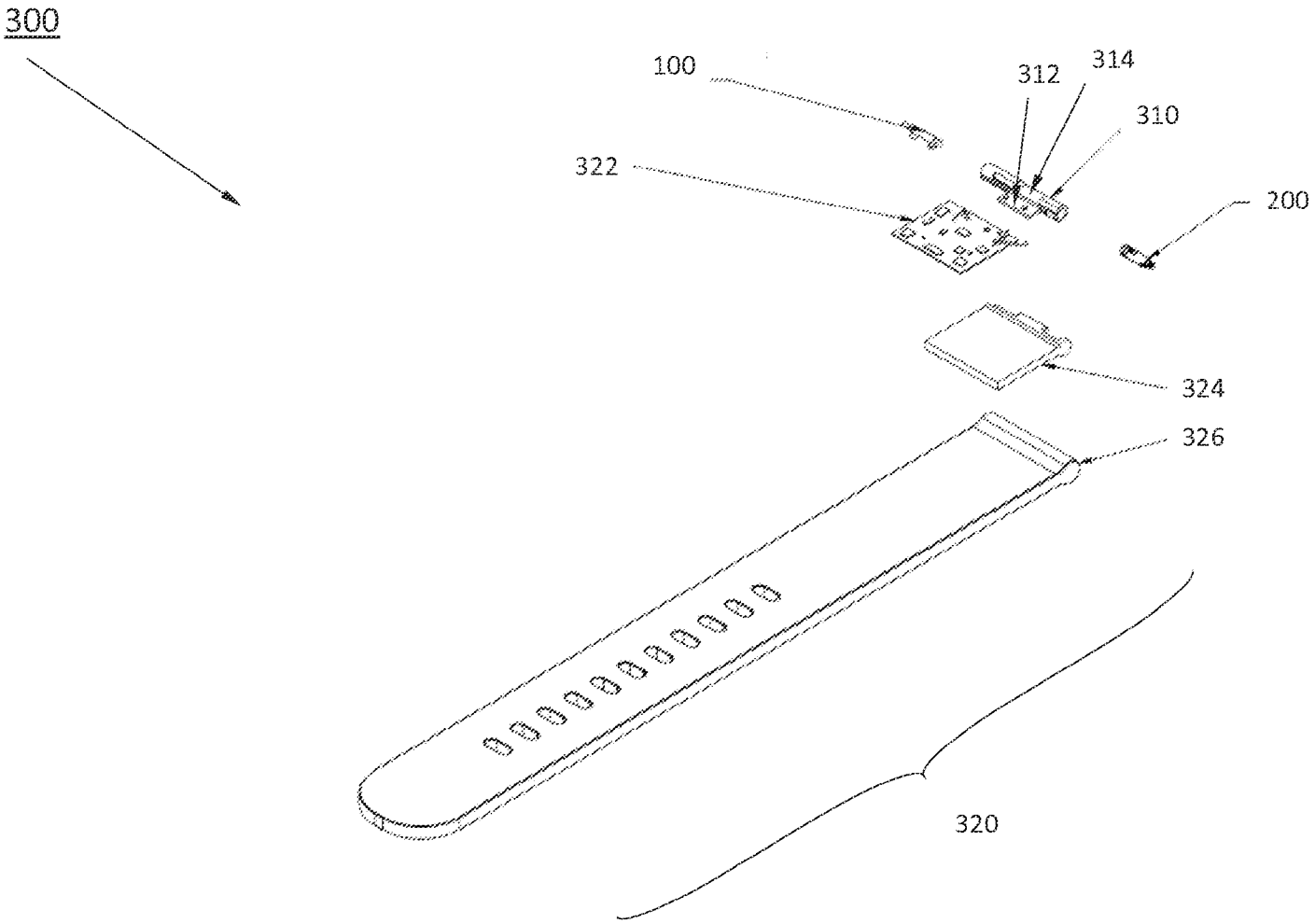
FIG. 3A shows an exploded isometric view exemplary configuration of electrical connectors attached to a securing device.

An advantage of the electrical connector 100, 100', 200 disclosed herein is that, in all of the disclosed configurations, the securing device to which the electrical connector is attached remains capable of rotating about the display device while maintaining an electrical connection between the two devices. FIG. 3A shows an exemplary configuration of one or more electrical connectors 100, 100', and/or 200, as they may be attached to a securing device and a display device (not shown).

In the system exemplary configuration 300 of FIG. 3A, an electrical connector with a quick-release lever 100 is paired with an electrical connector using concentric pins 200. One connector 100, 200 is shown on each side of the securing device. The electrical connectors 100, 200 are fitted into an external case 310 that holds the electrical connectors 100, 200 in position so that their connection pins 110, 210 are accessible to the contact points of the display device. The external case 310 also acts to mediate electrical connections between the caps 140, 280 of the electrical connectors 100, 200 and the securing device 320. The external case 310 mediates such an electrical connection by allowing the caps 140, 280 of the electrical connectors 100, 200 to abut against its connection panel 312, which is comprised of electrically conductive leads that may provide power, data, and/or ground connections to the circuit board 322 of the securing device 320, which is fitted into an inner mold 324. The external case 310 may also comprise a spacer 314 that keeps the connection pins of the electrical connectors 100, 100', 200 separated to prevent a connection failure. Together, the circuit board 322 and inner mold 324 can be inserted into the outer mold 326 of the securing device 320. In configurations in which one or more of the concentric pin electrical connectors 200 have a side interface 246, the external case 310 may have an opening along its longitudinal axis distal to the securing device 320 to allow for the side interface to contact with the display device and establish an electrical connection.

As shown in FIG. 3A, the external case 310 for the electrical connectors is substantially cylindrical, but may have any shape that allows for the snug insertion of the electrical connectors. Due to the shape of the external case 310 and the substantially circular face of the pins and point of contact against the display device, the configuration 300 is capable of freely rotating the securing device about the display device around the points of contact between the pins of the electrical connectors 100, 100', 200 and the display device.

It will be readily apparent to one of ordinary skill in the art that any of the configurations of electrical connectors 100, 100', 200 may be employed as disclosed in FIG. 3A. One or more power, data, and ground connections may be thus established between the display device and the securing device in this manner.

Figure 3B:
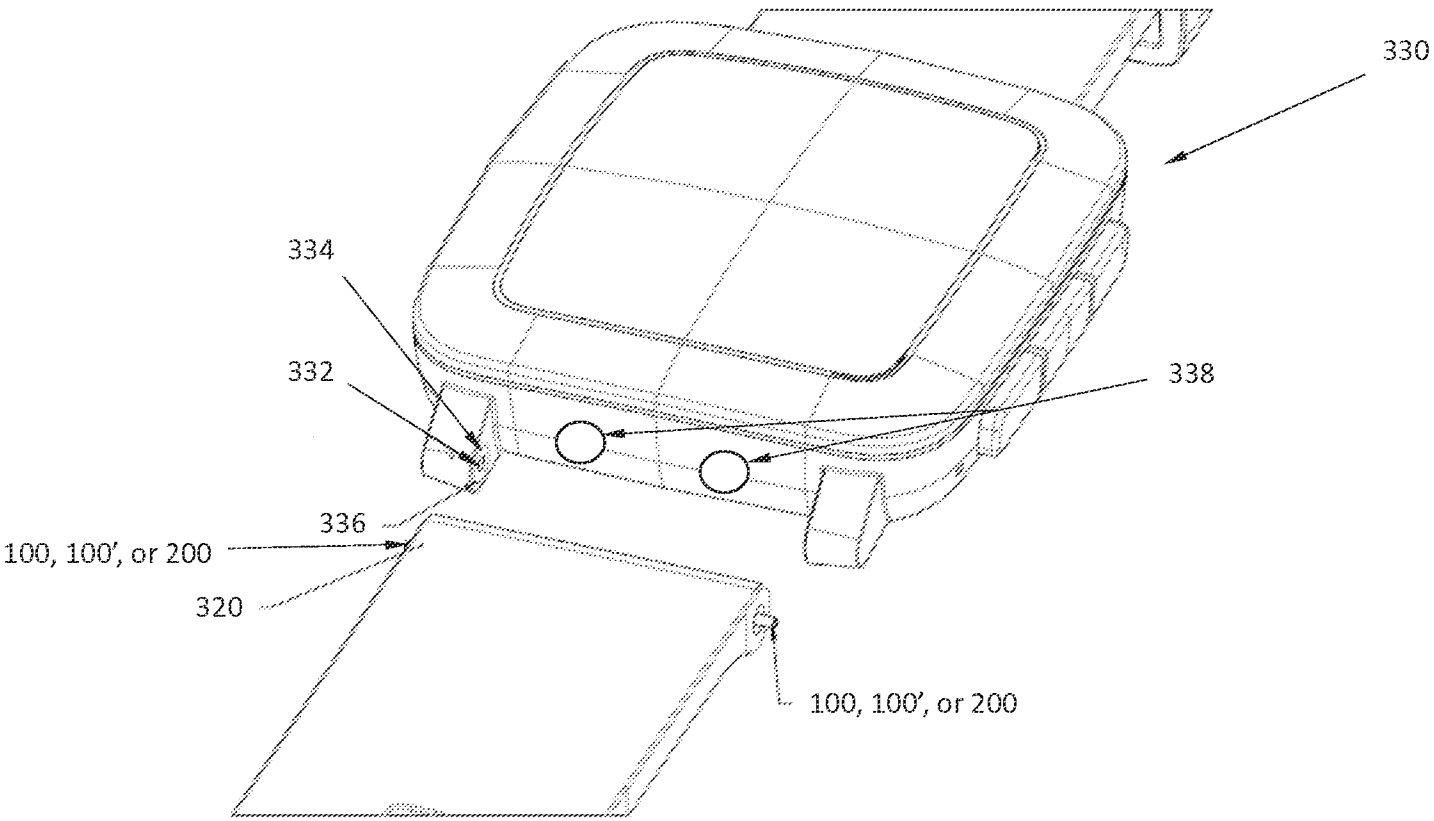
FIG. 3B shows an exemplary configuration of electrical connectors attached to securing device, further attached to a display device.

In FIG. 3B, the exemplary system configuration of FIG. 3A is shown paired with a display device 330. In particular, FIG. 3B shows the electrical connectors 100, 100', 200 removably attached to securing device 320 on either side. Together, the system configuration 300 is paired with the display device 330. The display device 330 is comprised of various points of contact that allow for attachment and electrical connections via the electrical connectors 100, 100', 200. The electrical connectors 100, 100', 200, the display device 330, and the securing device 320, together, comprise a wearable device. Examples of such wearable devices are watches, wristbands, fitness trackers, smart necklaces, and other similar implementations that will be readily apparent to those skilled in the art.

For each electrical connector 100, 100', 200, the display device has a connection point 332 for the connection pin 110, 110', 210 of the electrical connectors 100, 100', 200. The connection point 332 is the point of contact for the connection pin 110, 110', 210, resulting in the electrical connection between the securing device and the display device. The connection point 332 may connect power, data, or the ground. Surrounding the connection point 332 is an insulation band 334. The insulation band 334 keeps the plurality of electrical and/or ground connections separated, preventing shorts and damage to the display device or securing device. Surrounding the insulation band 334 is a concentric connection band 336. The concentric connection band 336 provides an additional point of contact for the concentric pin 240 of the concentric pin electrical connector 200 or for the outer casing 130, 130' of electrical connectors 100, 100', which is responsible for the ground connection. It will be readily apparent to one of ordinary skill in the art that additional concentric connection bands may be present, as long as they are separated by insulation bands that prevent shorts or damage to the display device 330 or the securing device 320.

The display device 330 may also have a plurality of mating interfaces 338 running along a face of the display device. These mating interfaces 338 are designed to contact or pair with the side interface 246 of electrical connector 200. Connection of the side interface 246 of electrical connector 200, as explained with respect to FIG. 2E above, results in an additional electrical connection between the display device 330 and the securing device 320.

The foregoing description and drawings should be considered as illustrative only of the principles of the electrical connector. The electrical connector may be configured in a variety of shapes and sizes and is not intended to be limited by the shown configurations. Numerous applications of the invention will readily occur to those skilled in the art. Therefore, it is not desired to limit the electrical connector to the specific examples disclosed or the exact construction and operation shown and described. Rather, all suitable modifications and equivalents may be resorted to, falling within the scope of this disclosure.

The invention claimed is:

1. An electrical connector comprising:

an outer casing terminating in a cap;

a connection pin having an uncovered portion and a portion covered by the outer casing;

a spring operably attached to the connection pin;

wherein the uncovered portion of the connection pin establishes an electrical connection between a securing device and a display device and the outer casing establishes a ground connection between the securing device and the display device; and wherein the securing device is able to rotate relative to the display device while maintaining the electrical connection and the ground connection between the securing device and the display device.

2. The electrical connector of claim 1, further comprising a substructure for attaching the connector to the securing device.

3. The electrical connector of claim 2, wherein the substructure comprises one of: a flange, a tab, an insert, and a coupling device.

4. The electrical connector of claim 1, further comprising a ground connection band wherein a ground connection is established between the securing device and the display device.

5. The electrical connector of claim 1, further comprising a quick-release lever operably connected to the connection pin.

6. The electrical connector of claim 1, wherein the electrical connector is part of a wearable device.

7. An electrical connector comprising:

a first pin insulator terminating in a first cap;

a first connection pin having an uncovered portion and portion covered by the first pin insulator;

a spring operably attached to the first connection pin;

a second pin insulator terminating in a second cap;

a second connection pin having an uncovered portion and a portion covered by the second pin insulator;

a spacer between the first cap and the second cap that separates the uncovered portion of the first connection pin from the uncovered portion of the second connection pin; and wherein the uncovered portion of the first connection pin establishes an electrical or ground connection between a securing device and a display device and the uncovered portion of the second connection pin establishes an electrical or ground connection between the securing device and the display device.

8. The electrical connector of claim 7, wherein:

the connector is removably attached to the securing device;

a longitudinal axis of the first connection pin and a longitudinal axis of the second connection pin are arranged linearly; and the uncovered portion of the first connection pin and the uncovered portion of the second connection pin face in substantially opposite directions, thereby providing a structural connection between the securing device and the display device by mating with interfaces of the display device.

9. The electrical connector of claim 7, wherein:

the connector is removably attached to the securing device; and the first connection pin and the second connection pin are removably connected to the display device such that the securing device is able rotate relative to the display device while maintaining the established connections between the securing device and the display device.

10. The connector of claim 7, wherein the spacer comprises an insulator or a hollow molded space between the first cap and the second cap.

11. An electrical connector comprising:

a first pin insulator terminating in a first cap;

a connection pin having an uncovered portion and a portion covered by the first pin insulator;

a spring operably attached to the first connection pin;

a second pin insulator terminating in a second cap;

a second connection pin having an uncovered portion and a portion covered by the second pin insulator;

a side interface located between the first connection pin and the second connection pin along the longitudinal axis of the connector;

a spacer that separates the first cap of the first connection pin from the second cap of the second connection pin and separating the side interface from both the first connection pin and the second connection pin;

wherein the uncovered portion of the first connection pin establishes an electrical or ground connection between a securing device and a display device, the uncovered portion of the second connection pin establishes an electrical or ground connection between a securing device and a display device;

and wherein the side interface establishes an electrical or ground connection between the securing device and the display device.

12. The electrical connector of claim 11, wherein the electrical connector is part of a wearable device.

13. The electrical connector of claim 11, wherein:

the connector is removably attached to the securing device; and the first connection pin, the second connection pin, and the side interface are removably connected to the display device such that the securing device is able rotate relative to the display device while maintaining the established connections between the securing device and the display device.

14. The electrical connector of claim 11, wherein the connector further comprises a substructure for attaching the connector to the securing device.

15. The connector of claim 14, wherein the substructure comprises one of: a flange, a tab, an insert, and a coupling device.

16. The electrical connector of claim 11, wherein the spacer comprises an insulator or a hollow molded space between the first cap and the second cap.

17. The electrical connector of claim 11, wherein the side interface comprises a lobe that protrudes from a longitudinal axis of the connector.

18. The electrical connector of claim 17, wherein:

the connector is removably attached to the securing device; and the first connection pin, the second connection pin, and the lobe are removably connected to the display device such that the securing device is able to rotate relative to the display device while maintaining the established connections between the securing device and the display device.

19. An electrical connector comprised of:

a first insulator;

a connection pin having a uncovered portion and a portion covered by the first insulator;

a spring operably positioned around the connection pin;

a second insulator;

a first concentric pin having an uncovered portion that encircles the first insulator and a portion that is covered by the second insulator;

a ground casing that covers the second insulator;

wherein the uncovered portion of the connection pin establishes an electrical connection between a securing device and a display device, the uncovered portion of the first concentric pin establishes an electrical connection between the securing device and a display device, and the ground casing establishes a ground connection between the securing device and the display device.

20. The connector of claim 19, wherein:

the connector is attached to the securing device; and the connection pin, the first concentric pin, and ground casing are removably connected to the display device such that the securing device rotates relative to the display device while maintaining the established connection between the securing device and the display device.

21. The connector of claim 19, wherein the connector further comprises a substructure for attaching the connector to the securing device.

22. The connector of claim 21, wherein the substructure comprises one of: a flange, a tab, an insert, and a coupling device.

23. The connector of claim 19, further comprising a quick-release lever operably attached to the connection pin.

24. The electrical connector of claim 19, wherein:

the electrical connector is attached to the securing device, and the electrical connector is rotatably attached to the display device whereby the securing device rotates about the connection pin.

25. The electrical connector of claim 19, further comprising a cap comprised of a base and a contact, wherein:

when the connection pin is in an installed position, an electrical connection is made between the connection pin and the contact; and when the connection pin is in a resting state position, no electrical connection is made between the connection pin and the contact.

26. The electrical connector of claim 19, wherein the electrical connector is part of a wearable device comprising the electrical connector, the display device, and the securing device.

* * * * *